US006279876B1

(12) United States Patent
Massie

(10) Patent No.: US 6,279,876 B1
(45) Date of Patent: Aug. 28, 2001

(54) HAMMER WITH INTEGRAL LEVER MECHANISM

(76) Inventor: Arnold Massie, 201 Camp Rd., Daniels, WV (US) 25832

( * ) Notice: Subject to any disclaimer, the term of this patent is extended or adjusted under 35 U.S.C. 154(b) by 0 days.

(21) Appl. No.: 09/662,671

(22) Filed: Sep. 15, 2000

Related U.S. Application Data

(63) Continuation-in-part of application No. 09/038,194, filed on Mar. 10, 1998, now abandoned.

(51) Int. Cl.[7] ..... B66F 15/00
(52) U.S. Cl. ..... 254/26 E
(58) Field of Search ..... 254/26 E, 26 R; 7/193–147

(56) References Cited

U.S. PATENT DOCUMENTS 2,643,854 * 6/1953 Johnson ..... 254/26 E
5,119,521 * 6/1992 Clontz ..... 7/143
5,249,776 * 10/1993 Johnson ..... 254/26 E
6,122,788 * 9/2000 Bulcock ..... 7/146

* cited by examiner

*Primary Examiner*—Robert C. Watson
(74) *Attorney, Agent, or Firm*—John D. Gugliotta

(57) ABSTRACT

A hammer with integral lever mechanism is disclosed, comprised of a traditional handle and claw head. To increase leverage during nail removal and enable the user to remove longer nails with speed and ease, a lever is incorporated into the design of the device. The lever is T-shaped, and in its resting position is located inside of the head, so as to not interfere with use of the device when the lever is not needed. The lever can be rotated relative to the head by depressing a lever release button, to aid in nail removal . The lever is of ratchet style configuration, allowing the user to position the lever in a multitude of locations relative to the head, to assist in removing nails of various lengths. The lever is capable of being locked into position relative to the head at each of the lever's possible positions. A hand guard and finger grips permit the user to maintain a firm hold on the handle during use, thus reducing risk of injury. A retractable tape measure is incorporated into the design of the handle.

11 Claims, 8 Drawing Sheets

HAMMER WITH INTEGRAL LEVER MECHANISM

RELATED APPLICATIONS

The present invention is a Continuation-in-Part Application of Utility patent application Ser. No. 09/038,194 filed on Mar. 10, 1998 now abandoned.

BACKGROUND OF THE INVENTION

1. Field of the Invention

The present invention relates generally to construction tools, and, more particularly, to a hammer with integral lever mechanism.

2. Description of the Related Art

The hammer is an important part of every construction worker's tool box. In addition, the hammer is used constantly by do-it-yourself home repair and remodelers. The hammer, as is well known, is used to nail fastening devices, such as nails, into wood or other materials. Most hammers also have a means for removing such fastening devices, such as a claw shaped protrusion or other mechanism which grips the nail. The head of the hammer is used as a fulcrum, creating leverage to remove the nail. However, many times the nails are very long, such as is the case with framing nails, and complete removal with a conventional hammer is difficult. This is because the lateral distance from the fulcrum point to the nail is smaller than the length of the nail as implanted in the board.

Traditionally, when this incomplete nail removal occurs, the worker must find a board or other similar device to place between the head of the hammer and the board, thus allowing the nail to be removed the rest of the way. However, finding a board to place under the hammer head is time consuming and tiring. In addition, using the hammer multiple times to remove the nail is time consuming and tiring. As an alternative, the worker could use a crowbar. However, this requires carrying an extra tool with him or her.

In the previous art, numerous attempts have been made to correct for the foregoing problem. Numerous devices attempt to address the problem of removing long nails by placing an extension rod at the top of the hammer head. The rod typically extends outward parallel to the centerline of the handle. Thus, the necessity of using a board is removed. Examples of this type of device include U.S. Pat. No. 5,441,236, issued in the name of Kiernan, U.S. Pat. No. 5,249,776, issued in the name of Johnson, U.S. Pat. No. 5,060,911, issued in the name of Mikesell, U.S. Pat. No. 4,422,620, issued in the name of Nitzberg, U.S. Pat. No. 2,657,903, issued in the name of Johnson, U.S. Pat. No. 2,643,854, issued in the name of Johnson, U.S. Pat. No. 2,589,047, issued in the name of Brown, U.S. Pat. No. 1,737,958, issued in the name of Carlson, and U.S. Pat. No. 540,967, issued in the name of Eveleth.

Such devices have one or more of the following problems associated with their use. First, the device is bulky, with the rod assembly adding significant weight to the device. Second, the rod interferes with use of the hammer when the rod is not needed. Third, the device still requires significant lateral movement of the handle to remove long nails. Fourth, the device is expensive to manufacture. Fifth, the device does not produce significantly enough force to remove very long nails. Sixth, raising the hammer up off the board or other material from which the nail is being removed and balancing the hammer by the rod end creates an unstable situation during use, with the hammer rotating and slipping along the rod end, increasing the risk of injury to the user. Seventh, the device does not increase the lateral distance between the nail, held by the claw of the hammer, and the fulcrum point. Without this feature, removal of the nail can still take more than one cycle of hammer movement.

A search of the prior art did not disclose any patents that read directly on the claims of the instant invention.

Consequently, a need has been felt for providing an improved apparatus and method which overcomes the problems cited above.

SUMMARY OF THE INVENTION

It is therefore an object of the present invention to provide an improved hammer with integral lever mechanism that provides additional leverage to remove long nails in one, simple, easy movement.

Briefly described according to one embodiment of the present invention, the hammer with integral lever mechanism is comprised of a traditional handle and claw head. To increase leverage during nail removal and enable the user to remove longer nails with speed and ease, a lever is incorporated into the design of the device. The lever is T-shaped, and in its resting position is located inside of the head, so as to not interfere with use of the device when the lever is not needed. The lever can be rotated relative to the head to aid in nail removal by depressing a lever release button. The lever is of a ratchet style configuration, allowing the user to position the lever in a multitude of locations relative to the head, to assist in removing nails of various lengths. The lever is capable of being locked into position relative to the head at each of the lever's possible positions. A hand guard and finger grips permit the user to obtain a firm hold on the handle during use, thus reducing risk of injury. A retractable tape measure is incorporated into the design of the handle.

It is another object of the present invention to provide a built-in lever which increases the lateral distance from the nail to the fulcrum point, thus allowing more of a nail to be removed easy and fast, in one movement of the hammer.

It is another object of the present invention to provide a built-in lever which increases the leverage needed to remove long nails, without requiring the use of a board or other device under the hammer head.

It is another object of the present invention to provide an adjustable ratcheting system in the hammer head such that the lever can be placed in a variety of positions. The lever folds out, locking in place in its desired position.

It is another object of the present invention to provide a spring loaded, quick release for the adjustable ratcheting system, thus making adjustment of the lever's position relative to the head quick and easy.

It is another object of the present invention to provide a lever that stores inside the hammer head when not in use. As such, when the lever feature is not in use, the present invention can be used as an otherwise conventional hammer.

It is another object of the present invention to provide a lever that is rubber coated, thus reducing damage to surfaces from which nails are being removed.

It is another object of the present invention to provide a finger guard, which protects the fingers on the handle from injury during use.

It is another object of the present invention to provide a handle with contoured finger grips that prevent the hand from slipping from the handle during use. These finger grips give the user a stronger grip on the hammer during use.

It is another object of the present invention to provide a means for attaching the device to a wall, thus eliminating clutter on a work bench.

It is another object of the present invention to provide a retractable tape measure built into the handle, thus relieving the worker from carrying around a separate tape measure. This feature is also beneficial because using it measuring where to place a nail is common in the construction trade.

It is another object of the present invention to provide a device that is simple in design, sturdy, and easy to use.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
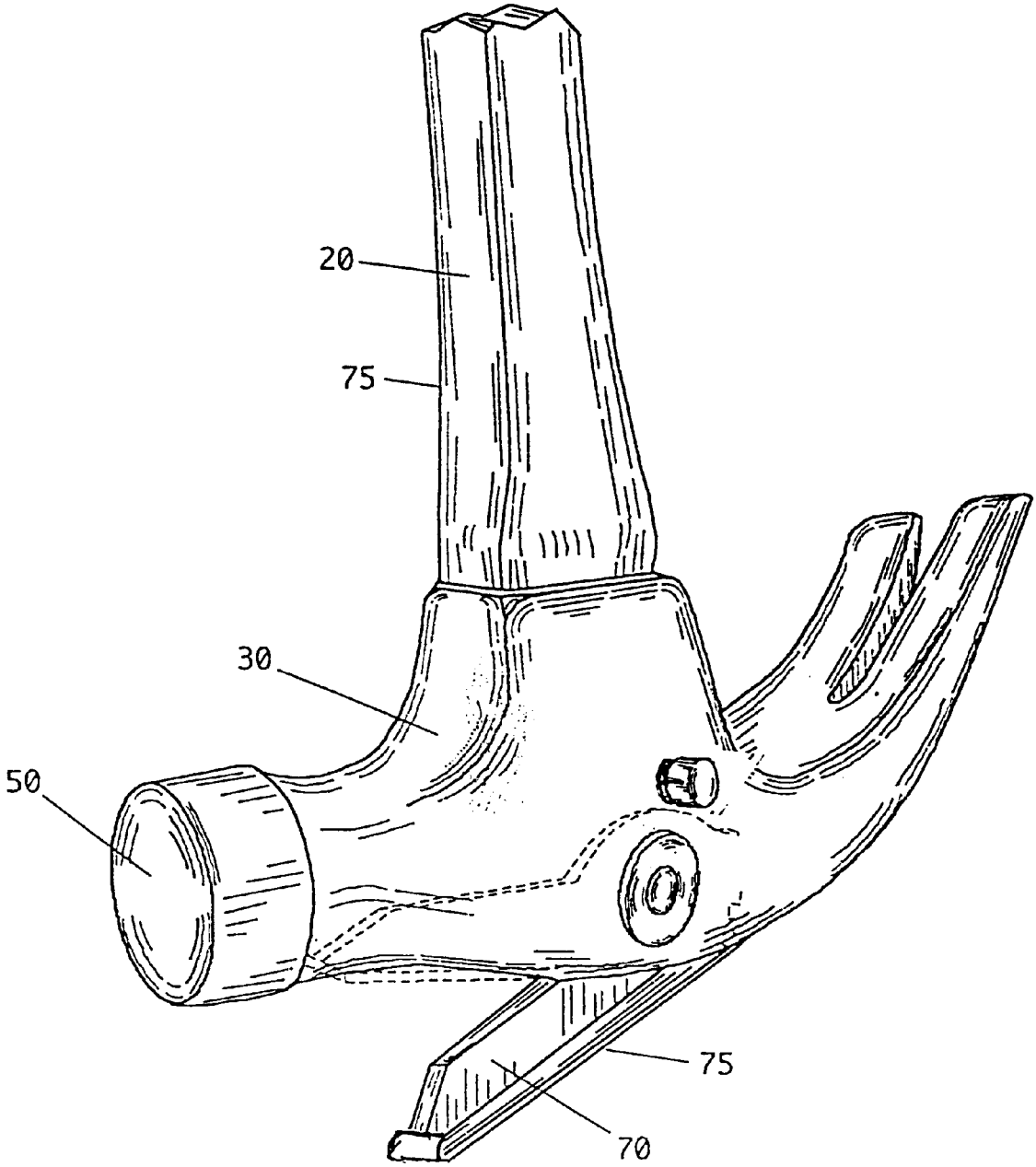
FIG. 1 is a left side perspective view of a preferred embodiment of a hammer with integral lever mechanism.

Referring now to FIG. 1, a hammer with integral lever mechanism 10 is shown, according to the present invention, disclosing a hammer of generally traditional configuration comprised of a handle 20 extending perpendicularly downward from a head 30. The handle 20 is an elongated, linear, cylindrical shaft which terminated into the head 30. The head 30 is overall of a traditional claw hammer configuration, with a set of claws 40 on one end and a cylindrical, flat striking surface 50 on the other. It is envisioned that other styles of standard specialty, or novel configuration can be easily incorporated into the teachings of the present invention, and only one particular configuration shall be shown and described for purposes of clarity of disclosure and not by way of limitation of scope. The head 30, claws, 40, and the striking surface 50 are made from a strong material, such as hardened steel.

Figure 2:
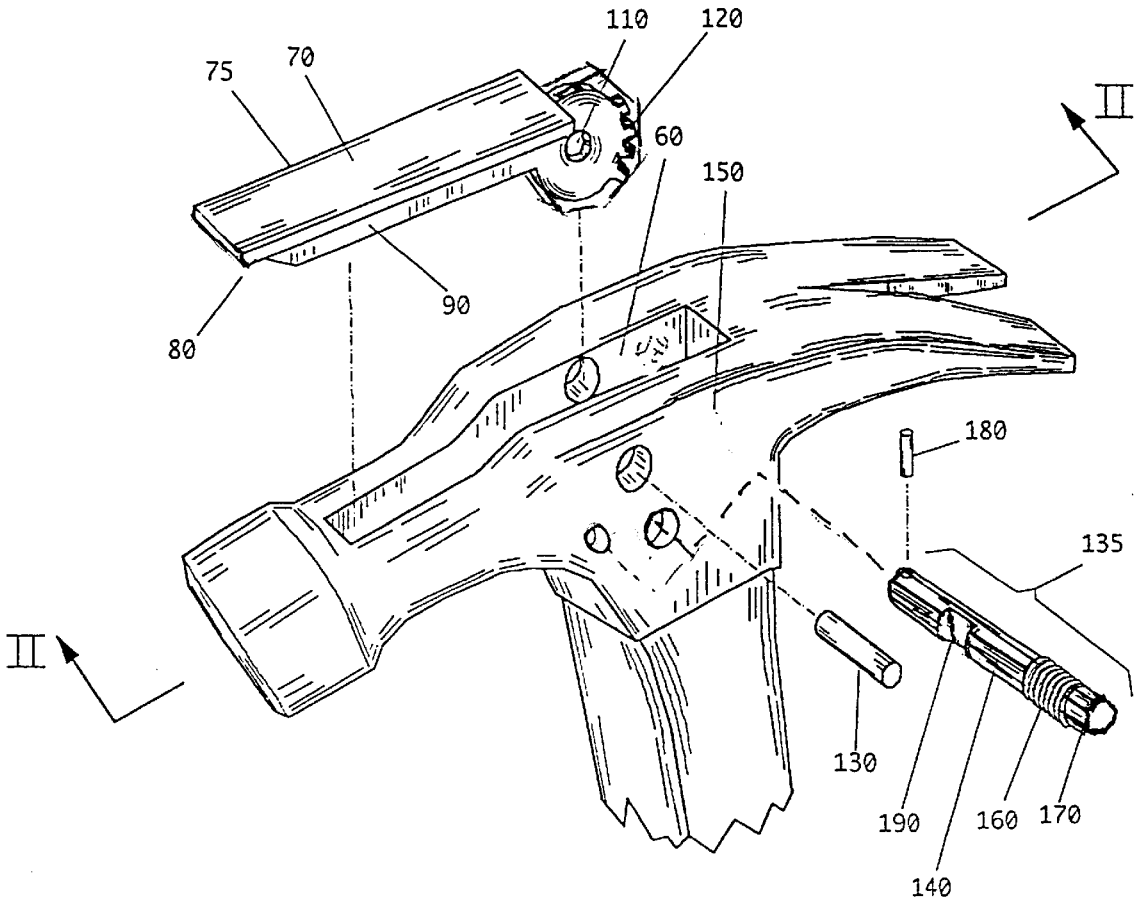
FIG. 2 is an exploded view thereof.

Referring now to FIG. 2, the top of the head 30, opposite the handle 20, has a head cavity 60 of generally rectangular configuration Additional leverage is provided by a lever 70. The lever 70 is of an elongated, T-shaped, configuration. The top portion 80 of the lever 70 is rectangular in configuration. The lever 70 is made from a strong material, such as hardened steel. The lever 70 is covered in a protective material 75, such as plastic, to reduce scratching of surfaces on which the lever 70 is used. The edge of front portion 80 of lever 70 is rounded to to minimize damage to the surface in which lever 70 must bear against. Attached to the centerline of the top portion 80, and extending along the centerline, perpendicular to the top portion 80, is a bottom portion 90. One end of the bottom portion 90 terminates in a slanted surface 95. The opposite ends of the top portion 80 and bottom portion 90 terminate into a generally rounded portion 100, at which point the lever 70 is attached to the head 30 of the device, as will be discussed below. A lever orifice 110 is formed by and extends through the assembly, with the radial center parallel to the main surface of top portion 80. Along the exterior surface of the rounded portion 100 are a series of equally spaced, identical semi-hexagonal octagonal, semi-triangular, or semi-square shaped detendes 120. The detendes 120 are located in the same vertical plane. These detendes 120 will be used to lock the lever 70 in place relative to the head 30, as will be explained below.

Figure 3B:
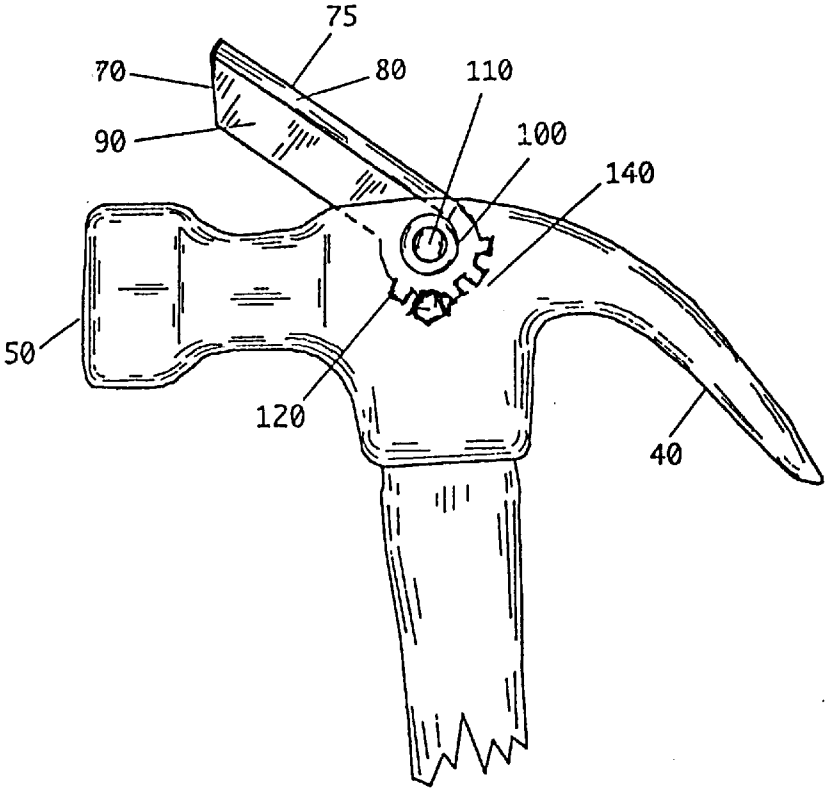
FIG. 3*b* is a left side view thereof, with the device prepared for use.
Figure 3A:
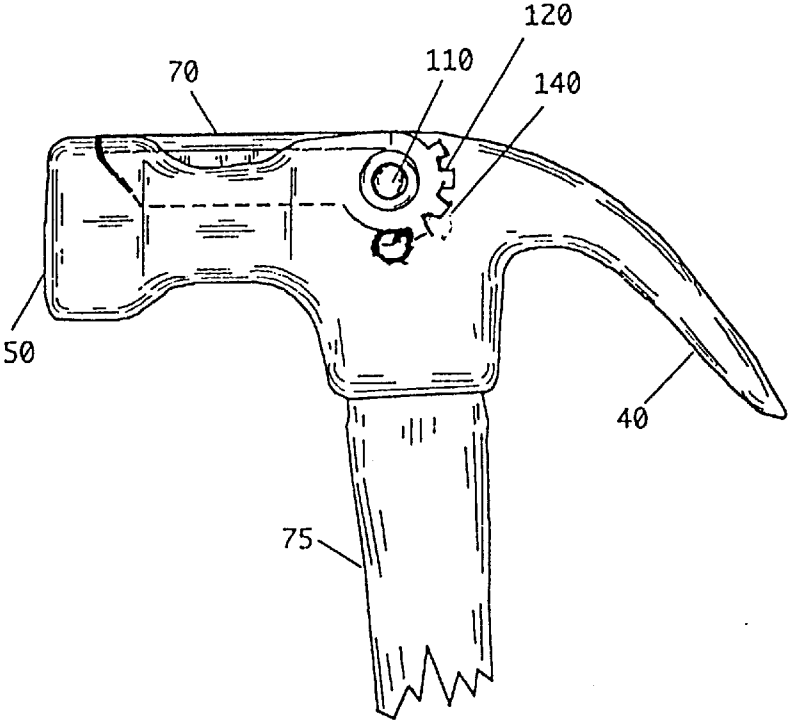
FIG. 3*a* is a left side view thereof, with the device in a resting position.

The head cavity 60, located inside the head 30, is of sufficient width, length and depth to hold the lever 70, complete with detendes 120, inside of it, with the top of the lever 70 flush against the top of the head 30. Referring now to FIGS. 2, 3*a* & 3*b*, the lever 70 is shown positioned inside the head cavity 60, at its resting position. The lever 70 is attached to the head 30 by a lever attachment means 130. The lever attachment means 130 in one preferred embodiment is a cylindrical, linear rod, of a cross sectional diameter less than that of the lever orifice 110. The lever attachment means 130 is attached to opposite ends of the walls of the head cavity 60, such attachment points being in horizontal linear alignment. The lever attachment means 130 passes through the lever orifice 110. As such, the lever 70 rotates in a vertical plane about this lever attachment means 130.

Figure 4:
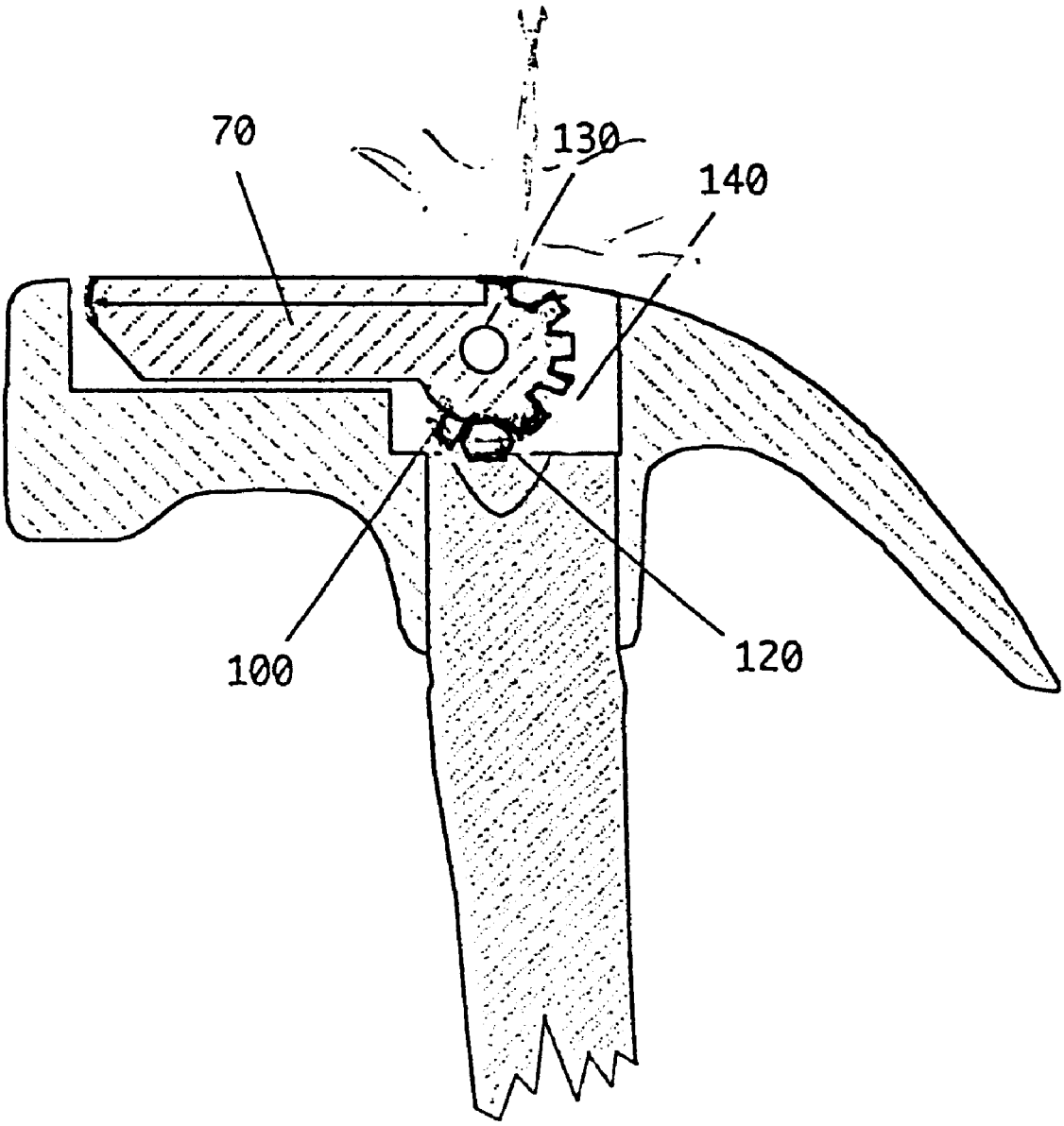
FIG. 4 is a left side cross sectional view thereof, cut along lines IV—IV of FIG. 2.

Referring now to FIGS. 2 & 4, a lever adjustment means 135 is located inside of the head cavity 60, between said lever attachment means 130 and said claws 40. The lever adjustment means 135 consists of a lever adjustment rod 140. The lever adjustment rod 140 is an elongated, hexagonal, triangular, or square rod, which is positioned parallel to the lever attachment means 130, and located so that the lever adjustment rod 140 is in mechanical interference with the detendes 120 of the lever 70.

Figure 5A:
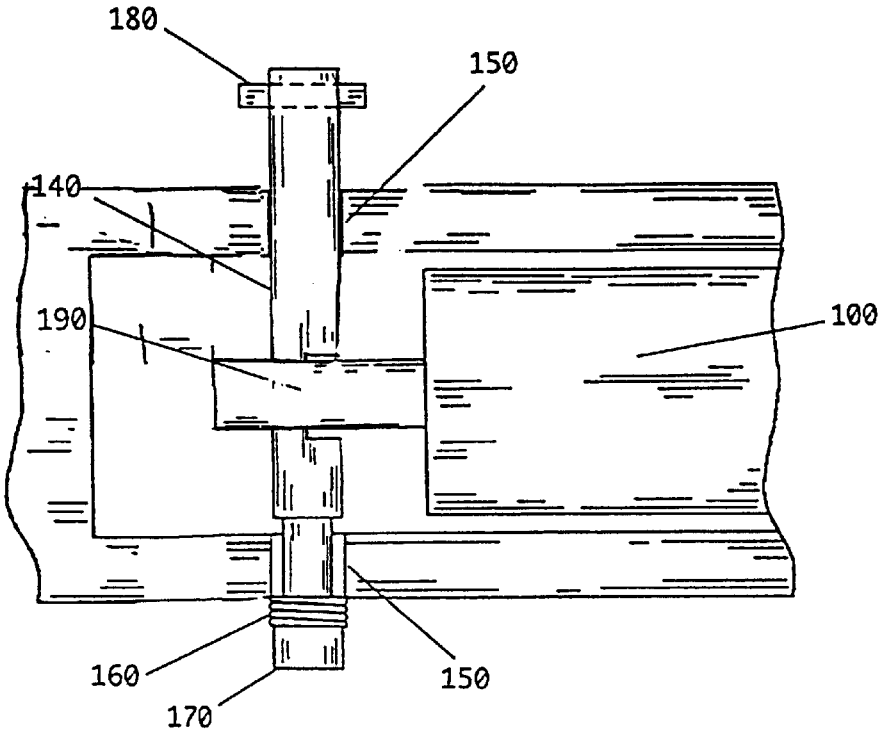
FIGS. 5*a* & 5*b* are a series of enlarged views of the internal components of the present invention, as they appear during use.
Figure 5B:
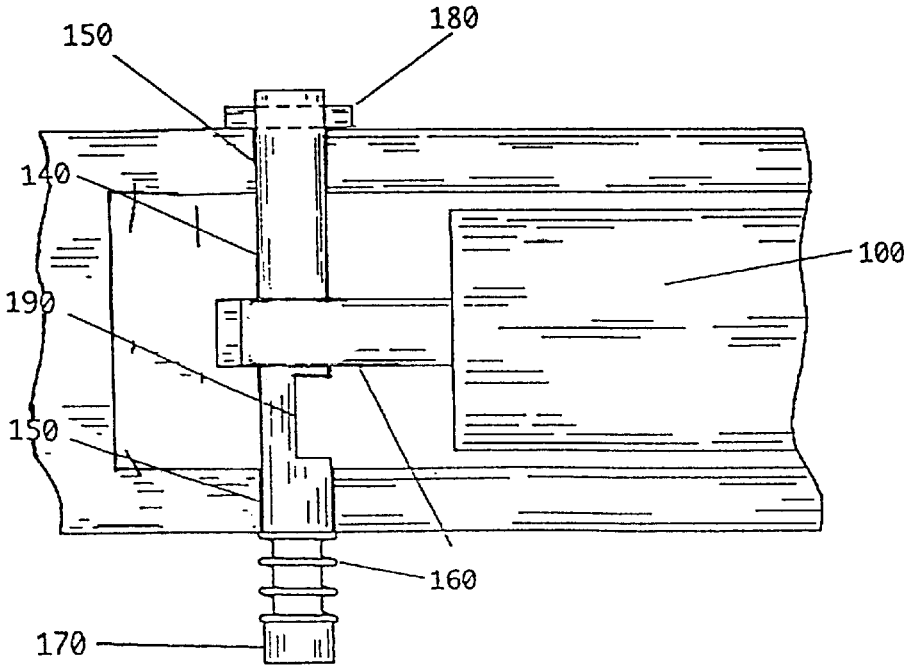

Referring now to FIGS. 2, 5*a* & 5*b*, two lever adjustment rod holes 150, located in the walls of the head cavity 60, permit the lever adjustment rod 140 to pass through the walls of the head cavity 60. The lever adjustment rod 140 is spring loaded, with a spring 160 positioned on the lever adjustment rod 140, outside the head cavity 60, on the exterior surface of the head 30. A lever release button 170 is located on the end of the lever adjustment rod 140, such that the spring 160 is held between the head 30 exterior wall and the lever release button 170. A lever adjustment rod retaining pin 180 is positioned on the end of the lever adjustment rod 140, opposite the lever release button 170, on the exterior surface of the head 30, opposite the spring 160.

A lever release gap 190 is positioned in the middle portion of the lever adjustment rod 140. The lever release gap 190 is of sufficient depth and width to permit the detendes 120 to pass by the lever adjustment rod 140, thereby eliminating the mechanical interference between the lever adjustment rod 140 and the detendes 120. The lever release gap 190 is positioned along the lever adjustment rod 140, just before the detendes 120, on the side of the lever adjustment rod 140 closer to the spring 160 and lever release button 170.

Referring now to FIG. 5*a*, the lever release button 170 is shown in a depressed condition, wherein the lever adjustment rod 140 slides relative to the detendes 120, and the lever release gap 190 comes into vertical planar alignment with the detendes 120, allowing rotation of the detendes 120 and lever 70 relative to the head 30, along the lever attachment means 130.

Referring now to FIG. 5*b*, when the lever release button 170 is released, the lever adjustment rod 140 returns to its original, resting position, once again in mechanical interference with the detendes 120, prohibiting further movement of the detendes 120. This ratchet type system allows the user to adjust the lever 70 along a predetermined radius of movement by depressing the lever release button 170, and locking the lever 70 in place, relative to the head 30, by releasing the lever release button 170.

Figure 6:
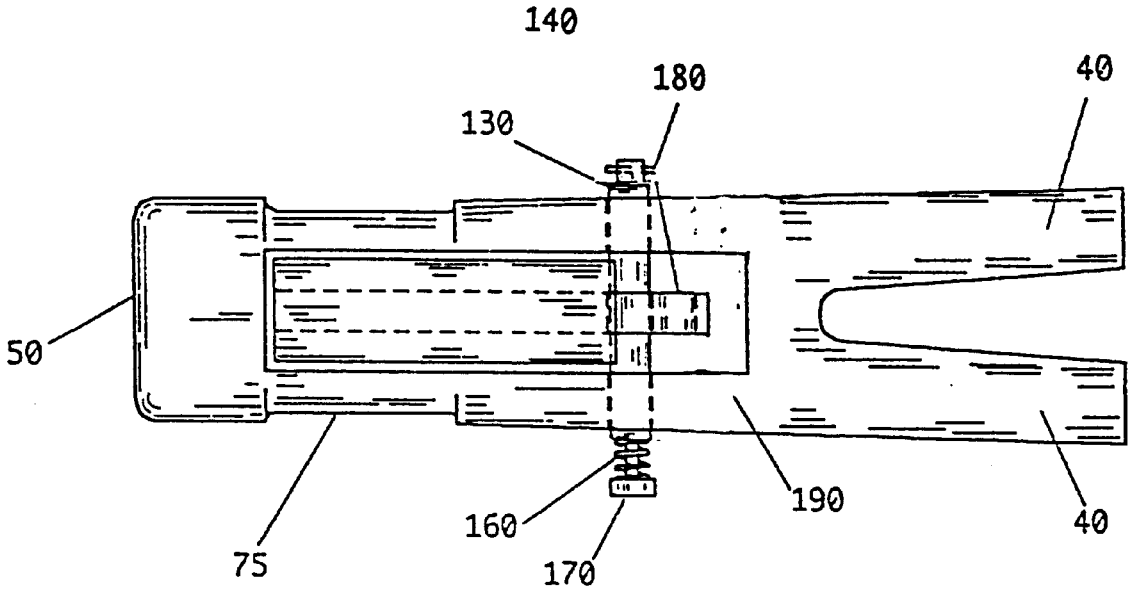
FIG. 6 is a top view thereof.

FIG. 6 shows the relation of the lever relative to the head 30.

Figure 7:
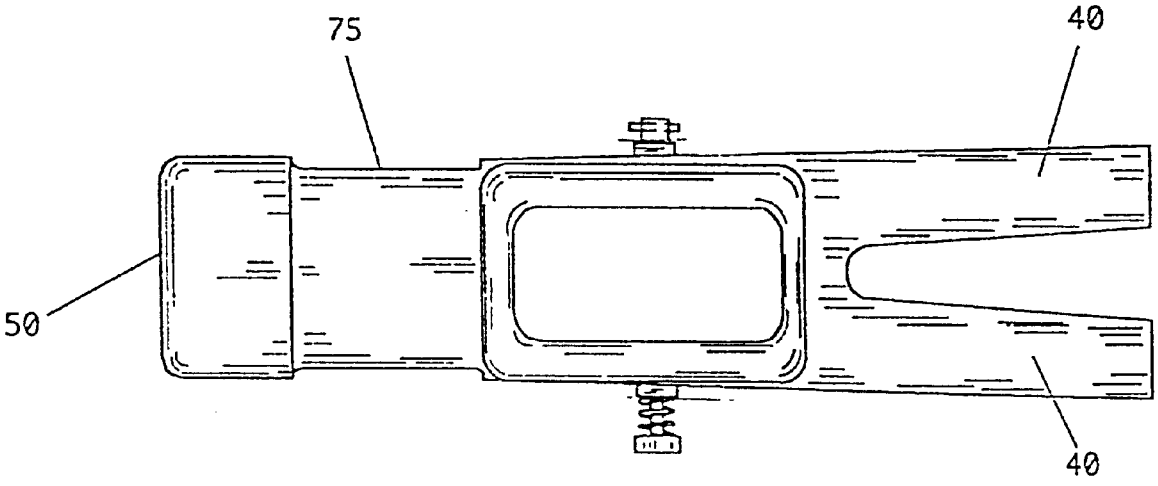
FIG. 7 is a bottom view thereof.

FIG. 7 shows the relation of the various parts of the present invention.

Figure 8:
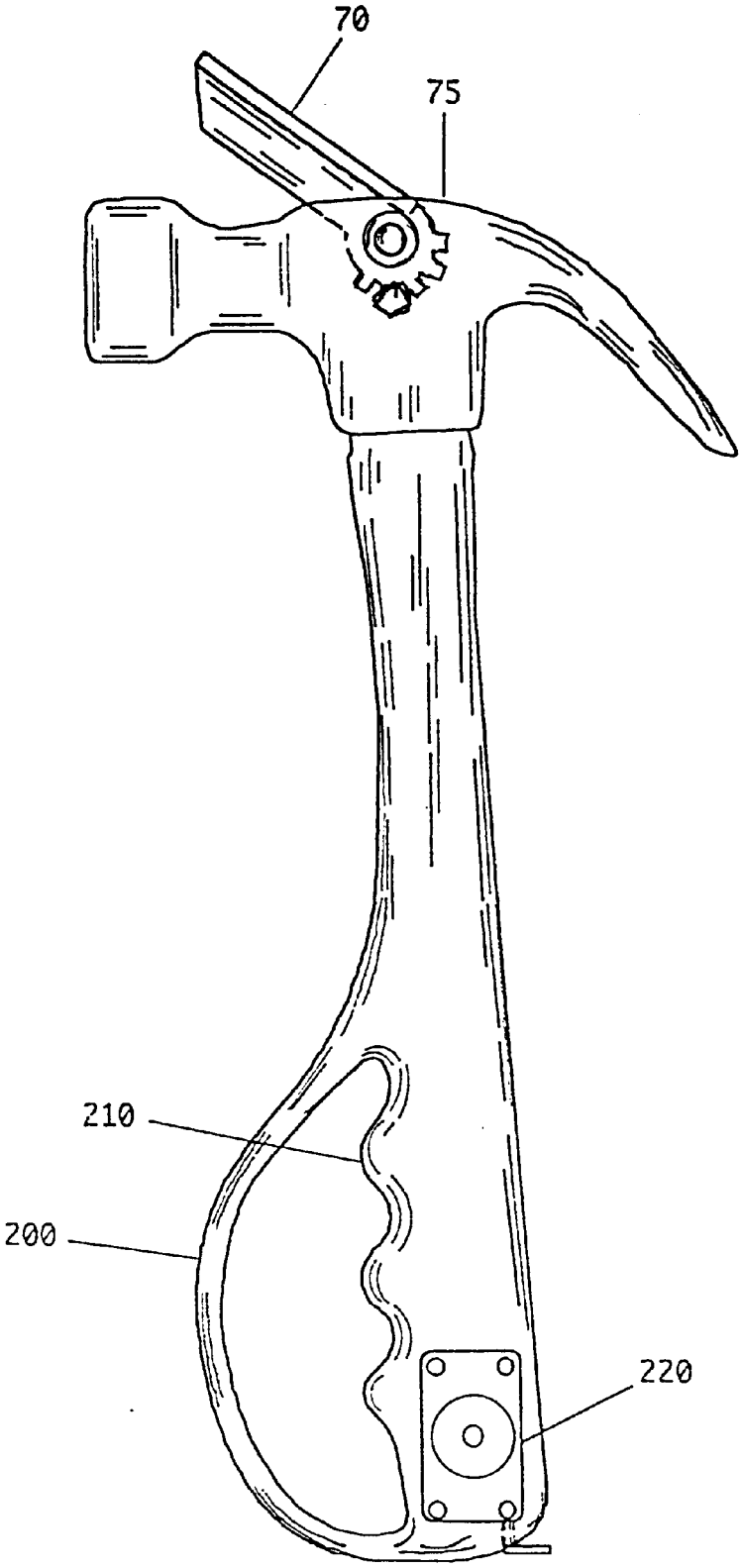
FIG. 8 is a side perspective view of an alternate embodiment of the present invention.

Referring now to FIG. 8, in an alternate embodiment of the present invention, the handle 20 portion, opposite the head 30, forms an integral hand guard 200. The hand guard 200 is cylindrical in configuration, extending outward from the handle 20 at two positions along the centerline of the handle 20, so as to form an enclosed space into which the palm of the user can be placed. Finger grips 210 are located on the handle 20, consisting of indentations in the handle 20 formed to hold fingers, much like a bicycle handle bar grip. It is envisioned that other handle 20 configurations will be used. Attached to the end of the handle 20, opposite the head 30, is a retractable tape measure 220. The retractable tape measure 220 is of standard size and configuration so as to be in proportion to the size of the handle 20, with the cross sectional area of the retractable tape measure 220 being less than the lateral width of the handle 20. The retractable tape measure 220 can be attached to the exterior surface of the handle 20 or located within the handle 20 itself. The handle 20, finger grips 210 and hand guard 200 are covered with a protective coating 75, such as plastic, to further improve hand gripping capabilities and to reduce damage and injury should the device be dropped.

2. Operation of the Preferred Embodiment

Figure 9:
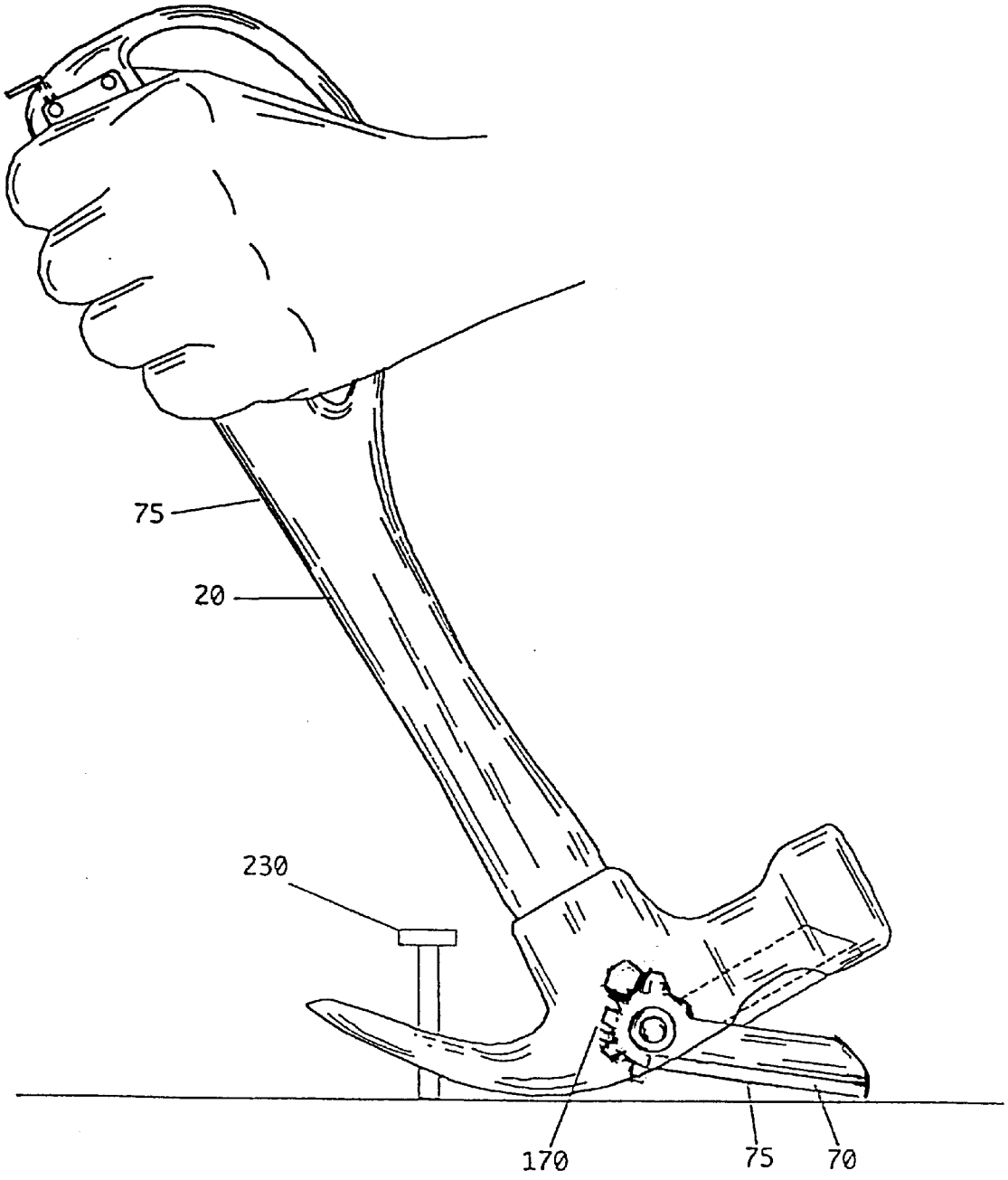
FIG. 9 is a side perspective of the preferred embodiment of the present invention, shown used for removing nails.

Referring now to FIG. 9, to use the present invention, the user depresses the lever release button 170, thus freeing the detendes 120 from mechanical interference with the lever adjustment rod 140. While holding the lever release button 170 in a depressed position, the user adjusts the lever 70 to the appropriate position relative to the head 30 that will facilitate removal of a nail 230 of a particular length. The user then inserts the claw 40 under the nail 230 head, and rests the upper portion of the lever 70 against the surface from which the nail 230 is being removed. The user then removes the nail 230 by utilizing the device as a fulcrum and lever. When the nail 230 is removed, the user depresses the lever release button 170 and rotates the lever 70 back into the resting position, with the lever 70 resting inside the head cavity 60, and the top portion 80 of the lever 70 flush with the top surface of the head 30. The device can now be used as a conventional hammer.

In the alternate embodiment with the hand guard 200, finger grips 210, and retractable tape measure 220, the user places his or her palm inside the hand guard 200 and wraps his or her fingers around the handle 20, resting the fingers of that hand in the finger grips 210. The retractable tape measure 220 is used in the traditional manner.

The foregoing description is included to illustrate the operation of the preferred embodiment and is not meant to limit the scope of the invention. The scope of the invention is to be limited only by the following claims.

What is claimed is:

1. A hammer with integral lever mechanism comprising:

a head, said head having two opposed ends spanned by a top, with a pair of parallel claws on one end and a striking surface being located on an opposing end opposite said claws; said pair of parallel claws being of a configuration to remove nails from boards;

a handle, said handle being an elongated, linear, cylindrical shaft which terminates into said head;

a lever, said lever having a top, said lever being pivotally connected to said head so as to allow said lever to provide additional leverage during the removal of nails;

a lever adjustment means, said lever adjustment means being located inside of said head, and used to manually adjust and lock said lever in place relative to said head, so as to facilitate use of said lever to increase leverage placed upon said set of parallel claws, wherein said lever has an elongated, T-shaped configuration, and said lever being further comprised of:

a generally rectangular top portion, said top portion having an upper surface;

a generally rectangular bottom portion, said bottom portion attached to said top portion along the centerline of said top portion and extending along the centerline of said top portion, with said bottom portion terminating at one end in a slanted surface;

a rounded portion, said rounded portion having an exterior surface, and said rounded portion being located at the opposite ends of the upper portion and bottom portion, opposite said slanted surface of said bottom portion, said rounded portion being the location where said lever is attached to said head;

a lever orifice, said lever orifice formed by and extending through said rounded portion, and having a radial center parallel to the upper surface of said top portion;

a plurality of detendes, said detendes being located on said exterior surface of said rounded portion, equally spaced, in a linear series, and each said detende located in the same vertical plane, said detendes being used to lock said lever in place relative to said head.

2. The hammer with integral lever mechanism of in claim 1, said head further comprising:

a generally rectangular head cavity, said head cavity formed by and located at said top of the head, and extending into said head, toward said handle, said head cavity being of sufficient width, length and depth to hold said lever within and enclosed such that said lever rests flush against the top of said head.

3. The hammer with integral lever mechanism described in claim 2, wherein said head further comprises:

lever attachment means, said lever attachment means being used to attach said lever in a locking, pivotal manner, to said head.

4. The hammer with integral lever mechanism of claim 3, wherein said lever attachment means is a cylindrical, linear rod, of cross sectional diameter less than that of said lever orifice, said lever attachment means being attached to opposite ends of the walls of said head cavity, such attachment points being in horizontal linear alignment, with said lever attachment means passing through said lever orifice, such that said lever rotates in a vertical plane about said lever attachment means.

5. The hammer with integral lever mechanism of claim 4, said lever adjustment means further comprising:

a lever adjustment rod, said lever adjustment rod being located inside of the head cavity, and being an elongated, rectangular or cylindrical rod, which is positioned parallel to said lever attachment means, located between said lever attachment means and said claws, and located so that said lever adjustment rod is in mechanical interference with said detendes;

two lever adjustment rod holes, said lever adjustment rod holes being formed by said walls of said head cavity, permitting said lever adjustment rod to pass through said walls of said head cavity;

a spring, said spring used for urging said lever adjustment rod, said spring positioned on said lever adjustment rod, outside said head cavity, on the exterior surface of the head;

a lever release button, said lever release button being located on the end of said lever adjustment rod, such that said spring is held between said head exterior surface and said lever release button;

a lever adjustment rod retaining pin, positioned on said end of said lever adjustment rod, opposite said lever release button, on said exterior surface of said head, opposite said spring;

a lever release gap, said lever release gap being positioned in said middle portion of said lever adjustment rod, said lever release gap being of sufficient depth and width to permit said detendes to pass by said lever adjustment rod, eliminated the mechanical interference between said lever adjustment rod and said detendes.

6. The hammer with integral lever mechanism of claim 5, wherein said lever release gap being positioned just before said detendes, on the side of said lever adjustment rod closer to said spring and said lever release button, such that when said lever release button is depressed, said lever adjustment rod slides relative to said detendes, and said lever release gap comes into alignment with said detendes, allowing rotation of said detendes, and said lever relative to said head, along said lever attachment means, and when said lever release button is released, said lever adjustment rod returns to its original, resting position, once again in mechanical interference with said detendes, prohibiting further movement of said detendes.

7. The hammer with integral lever mechanism of claim 6, wherein the lever adjustment means allows the user to adjust said lever along a predetermined radius of movement by depressing said lever release button, and locking said lever in place, relative to said head, by releasing said lever release button.

8. The hammer with integral lever mechanism of claim 7, wherein said hammer further comprises a hand guard, said hand guard being located on said handle, opposite said head, said hand guard being cylindrical in configuration, extending outward from said handle at two positions along the centerline of said handle, so as to form an enclosed space into which the palm of the user's can be placed;

finger grips, said finger grips located on said exterior surface of said handle, said finger grips consisting of indentations in said handle formed to hold fingers, much like a bicycle handle bar grip;

a retractable tape measure, said retractable tape measure being located on said end of said handle, opposite said head, said retractable tape measure being of standard size and configuration so as to be in proportion to said handle size, with the cross sectional area of said retractable tape measure being less than the lateral width of said hammer with integral lever mechanism, said retractable tape measure being capable of being attached to said exterior surface of said handle or located within said handle itself.

9. The hammer with integral lever mechanism of claim 8, wherein said finger grips and said hand guard are covered with a protective coating, said protective coating designed to further improve hand gripping capabilities and to reduce damage and injury.

10. The hammer with integral lever mechanism of claim 9, wherein said lever rests inside of said head cavity so as to not interfere with use of said hammer as a conventional hammer.

11. The hammer with integral lever mechanism of claim 10, wherein said head, handle, claws, striking surface and lever are made from metal.

* * * * *